United States Patent [19]

Fair

[11] 4,428,289

[45] Jan. 31, 1984

[54] PRECISION VERTICAL REGISTRATION ADJUSTMENT DEVICE FOR A PRINTING PRESS

[76] Inventor: Gary R. Fair, 3613 Princetown Ct., Lacey, Wash. 98503

[21] Appl. No.: 366,725

[22] Filed: Apr. 8, 1982

Related U.S. Application Data

[63] Continuation-in-part of Ser. No. 256,091, Apr. 21, 1981, abandoned.

[51] Int. Cl.[3] ..... B41F 13/14

[52] U.S. Cl. ..... 101/248; 101/DEG 13

[58] Field of Search ..... 101/248, DIG. 13, 132.5

[56] References Cited

U.S. PATENT DOCUMENTS

| | | | |
|---|---|---|---|
| 2,957,409 | 10/1960 | Foulks | 101/248 X |
| 3,042,996 | 7/1962 | Nelson | 101/23 X |
| 3,306,188 | 2/1967 | Couzens et al. | 101/248 X |
| 3,363,554 | 1/1968 | Mestre | 101/248 |
| 3,512,477 | 5/1970 | Nelson | 101/248 X |
| 3,783,784 | 1/1974 | Booleless | 101/248 |
| 3,793,899 | 2/1974 | Bourbonnaud | 101/248 X |
| 4,195,569 | 4/1980 | Lislig | 101/248 |

OTHER PUBLICATIONS

"Multigraph Multileth Offset Duplicator Reference Manual", pp. 28–30.

"Multileth Offset Model 1850 Reference Manual", pp. 4, 33–37.

*Primary Examiner*—Edward M. Coven

*Attorney, Agent, or Firm*—Gregory W. Moravian; Don R. Mollick

[57] ABSTRACT

A device for making fine adjustments of the vertical registration of a printing press of the type having a master cylinder and a master cylinder gear selectively rotatable with respect to each other. The device includes a shoe releasably secured to the master cylinder gear and a pair of opposed vertical adjustment screws carried by the shoe and bearing against the master cylinder. Fine adjustments of the vertical registration are obtained by securing the shoe to the master cylinder gear and then screwing in one vertical adjustment screw while backing out the other a corresponding amount, thereby rotating the master cylinder and master cylinder gear relative to each other. Controlled rotations of less than about five one-thousandths an inch can be made with ease. Since the shoe is releasably secured to the master cylinder gear, the device can be utilized to make its fine adjustments at any given position of the master cylinder and master cylinder gear with respect to each other.

5 Claims, 22 Drawing Figures

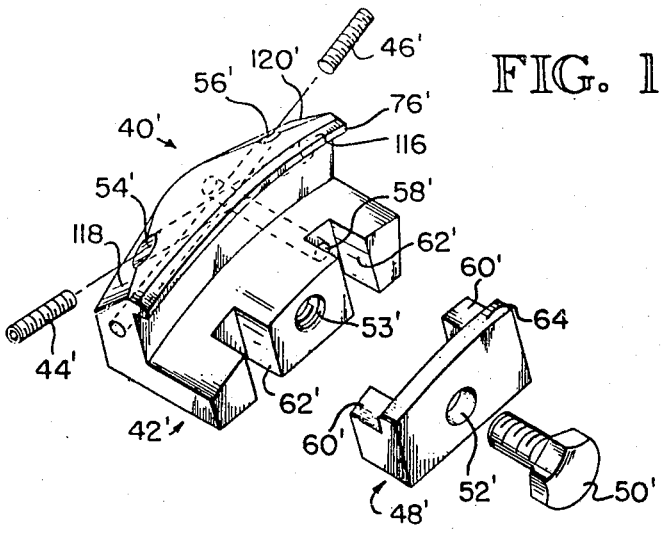
FIG. 18
FIG. 19
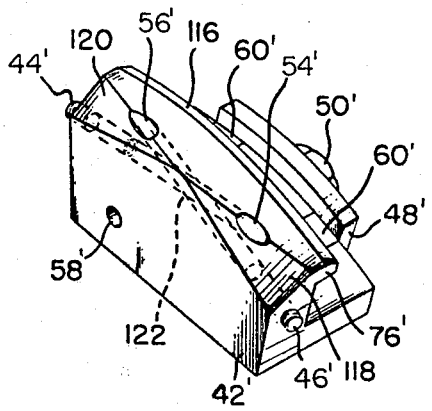
FIG. 20
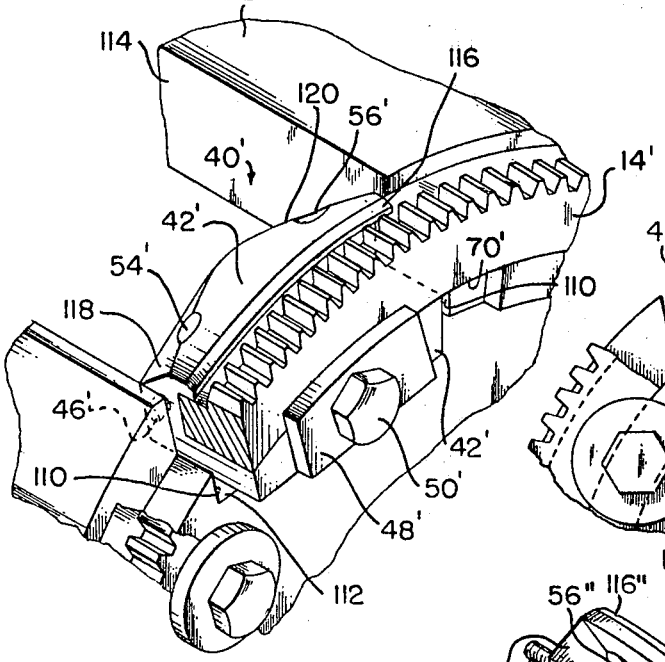
FIG. 21
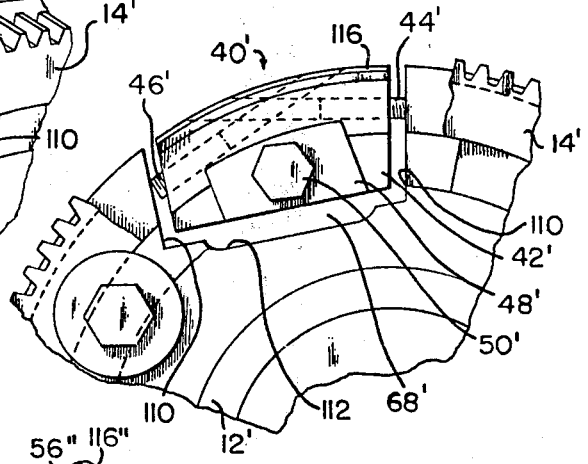
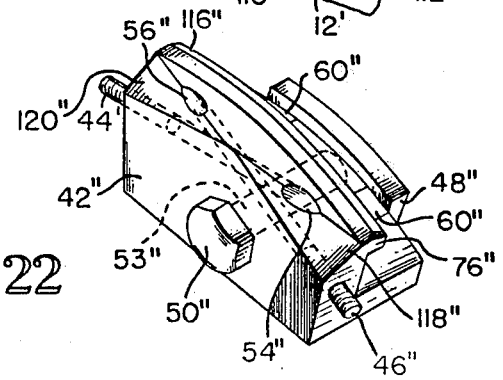
FIG. 22

PRECISION VERTICAL REGISTRATION ADJUSTMENT DEVICE FOR A PRINTING PRESS

BACKGROUND OF THE INVENTION

This is a continuation-in-part of application Ser. No. 256,091 filed Apr. 21, 1981 abandoned.

The present invention relates to devices for adjusting the vertical registration of printing presses, and more particularly to a device which permits the very fine adjustment of the vertical registration at any given position of the master cylinder and master cylinder gear of the printing press with respect to each other.

BRIEF SUMMARY OF THE INVENTION

By way of non-limiting example, the present invention will be illustrated with respect to the Multilith Model 1250 Offset Printing Press which has been manufactured by the Addressograph Multigraph Corporation of Mt. Prospect, Ill., 60056 for over thirty years. During this time there have been some minor changes in the press; however, it is basically the same as it was when it was first introduced into the market. Further, the press' different master cylinders, and Hamada presses will be discussed.

The Model 1250 was designed primarily as a duplicator rather than a quality printing press. The difference between these two classifications is the quality of printing produced from the equipment and the degree of skill required to operate the press. The duplicator generally produces a lower quality printed product and requires a lower degree of skill to operate.

As technology in the area of printing supplies improved, and as the Multilith 1250 was improved by its manufacturer, most print shops quickly realized that the Multilith 1250 was far more than a duplicator. It could be used to produce high quality printing jobs normally produced on offset presses costing several times the retail price of the 1250 press. However, there is presently a limitation with the Multilith 1250 in the area of registration that, until the present invention, has never been fully solved.

Registration can be divided into two basic categories. The first basic category is the ability of the press to print the same identical image in the same identical position on consecutive sheets of paper as they are fed through the press. The Multilith 1250 has always been able to do this if it was properly adjusted and had a reasonably competent operator.

The second basic registration category deals with the ability of the press operator to put a second image in an exact position in relation to another image that is already printed on a sheet of paper, such as, for instance, registering a blue ink image in relation to a red ink image on a two color printing job. This second basic registration category includes three distinct registration problems; namely skew (the image on the paper is not printed parallel to the edge of the sheet of paper), horizontal registration, and vertical registration.

The Multilith 1250 has the ability to be able to adequately correct and adjust both skew and horizontal registration problems. However, the Multilith 1250 does not have the ability to quickly make fine, accurate vertical registration adjustments.

It is true that the Multilith 1250 is equipped with a very crude vertical adjustment mechanism, but the mechanism is such that it makes it very difficult for the average press operator to make very fine, close vertical registration adjustments of one image in relation to another image. Only highly skilled operators can make these ajustments with any degree of productivity, and even in these cases set-up productivity is reduced by about fifty percent. In addition, paper and plate wasteage is increased significantly in close-register set-up work because of the trial and error before exact registration is achieved.

As a result, one of two situations generally exist, either the Multilith 1250 is used at significantly increased production costs to produce close-register offset printing, or the close-register work is not attempted because of the increased costs due to the inability of the operator to make quick, accurate, fine vertical registration adjustments.

Accordingly, the primary object of the present invention is to provide a device which will enable printing presses, and in particular the Multilith 1250, to quickly make fine, accurate vertical registration adjustments.

Another object is to provide such a device which will also enable fine vertical registration adjustments to be made at any given initial position of the printing press's master cylinder and master cylinder gear with respect to each other.

A further object is to provide such a device which is also quickly and easily installed on and/or removed from existing printing presses; but which may also, perhaps, be offered as original equipment on new printing presses.

Another object is to provide such a device which will also be relatively inexpensive to manufacture, in relation to the savings it generates for the purchaser, and yet has a long service life.

In basic form, the present invention comprises a wide shoe which may be releasably secured, as with a locking clamp and screw, to a printing press's master cylinder gear. The shoe carries a pair of opposed vertical adjustment screws which bear against the printing press's master cylinder. When the master cylinder gear is released so it and the master cylinder may move relative to each other, fine adjustments of the vertical registry may be made in the desired direction by first screwing up one vertical adjustment screw the desired amount after which the other vertical adjustment screw may be screwed down a corresponding amount. When the desired amount of adjustment has been made, the master cylinder gear is then reaffixed to the master cylinder.

It should be noted that the forgoing is not intended to be a limitation on the scope of the present invention since it is but a brief summary of some of the objects, features, advantages and characteristics of the present invention. These and further objects, features, advantages and characteristics of the present invention will become more apparent from the brief description of the drawings and detailed description of the preferred embodiments of the present invention which follow.

BRIEF DESCRIPTION OF THE DRAWINGS

FIG. 18 is an exploded perspective view taken from the rear of a second form of the present invention;

FIG. 19 is a perspective view of said second form, when assembled, taken from the front thereof;

FIG. 20 is an isometric perspective view of said second form shown installed in a printing press, some parts being broken away for clarity;

FIG. 21 is an end elevational view of said second form shown installed on a printing press; and FIG. 22 is a perspective view of a third form of the present invention, taken from the front thereof showing the fastening bolt going through the front thereof.

DETAILED DESCRIPTION OF THE PREFERRED EMBODIMENTS

Figure 1:
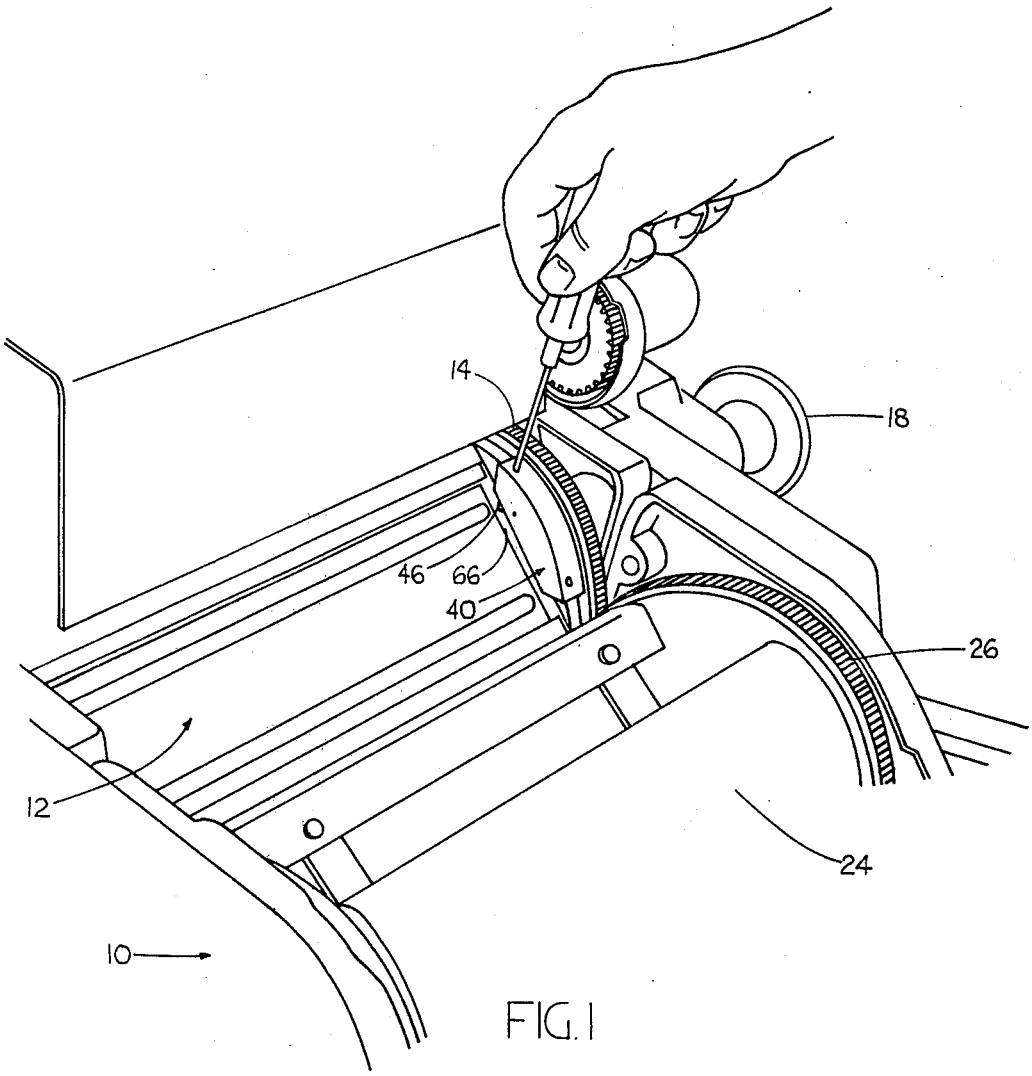
FIG. 1 is a perspective view illustrating the adjustment of the present invention while installed on a printing press.
Figure 11:
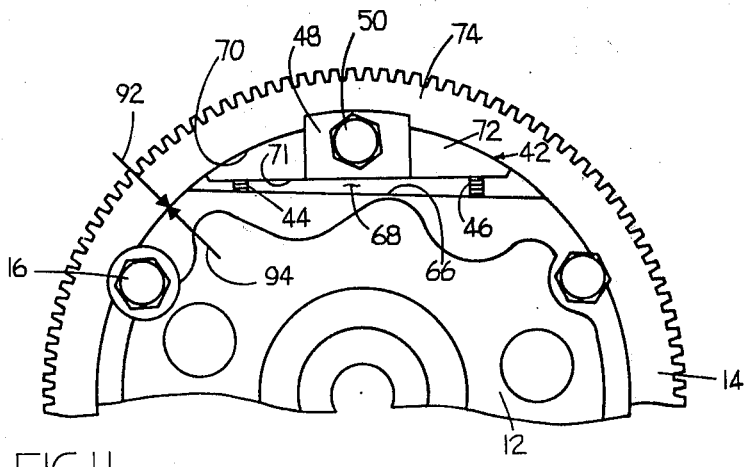
FIGS. 11 and 12 are rear elevational views showing the present invention installed and being adjusted to two different operating positions.
Figure 12:
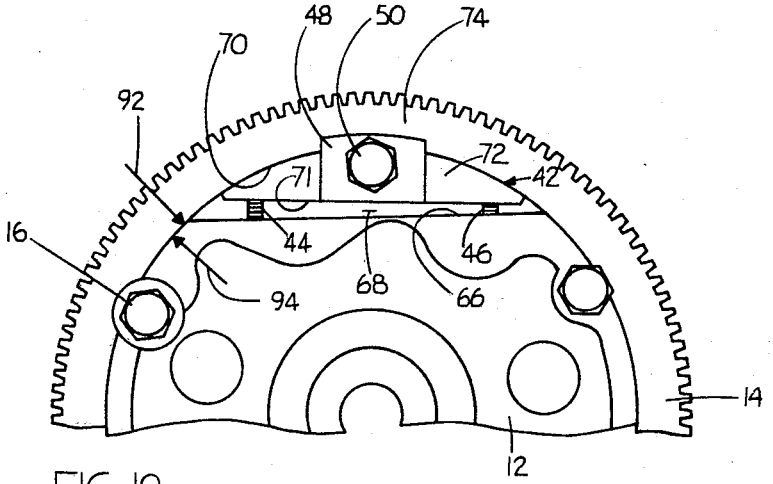

Referring now to FIG. 1, by way of non-limiting example, a Multilith Model 1250 offset printing press, manufactured by the Addressograph Multigraph Corporation of Mt. Prospect, Ill. 60056, is shown generally designated at 10. The press 10 includes a master cylinder 12 driven by a master cylinder gear 14 which is releaseably secured thereto by a clamp screw 16 (FIGS. 11 and 12). The clamp screw 16 can be engaged and tightened or loosened with the spring loaded clamp screw control handle 18 (FIG. 1).

Figure 13:
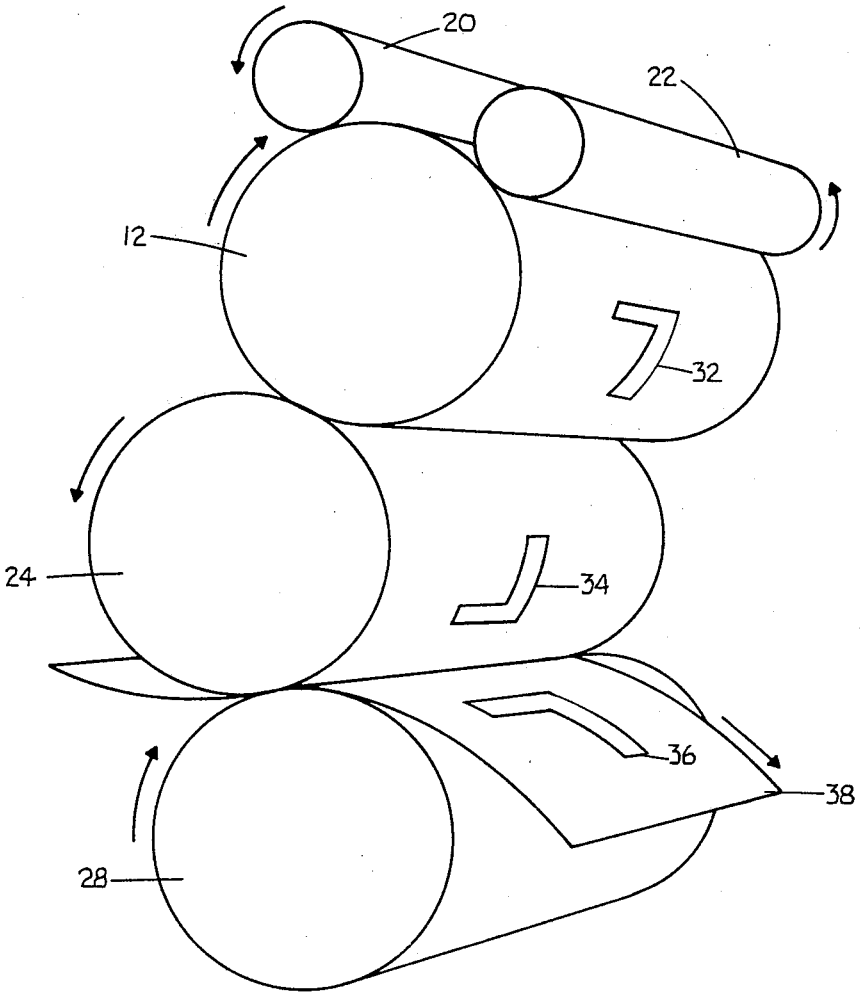
FIG. 13 is a diagrammatic representation of an offset printing press.
Figure 14:
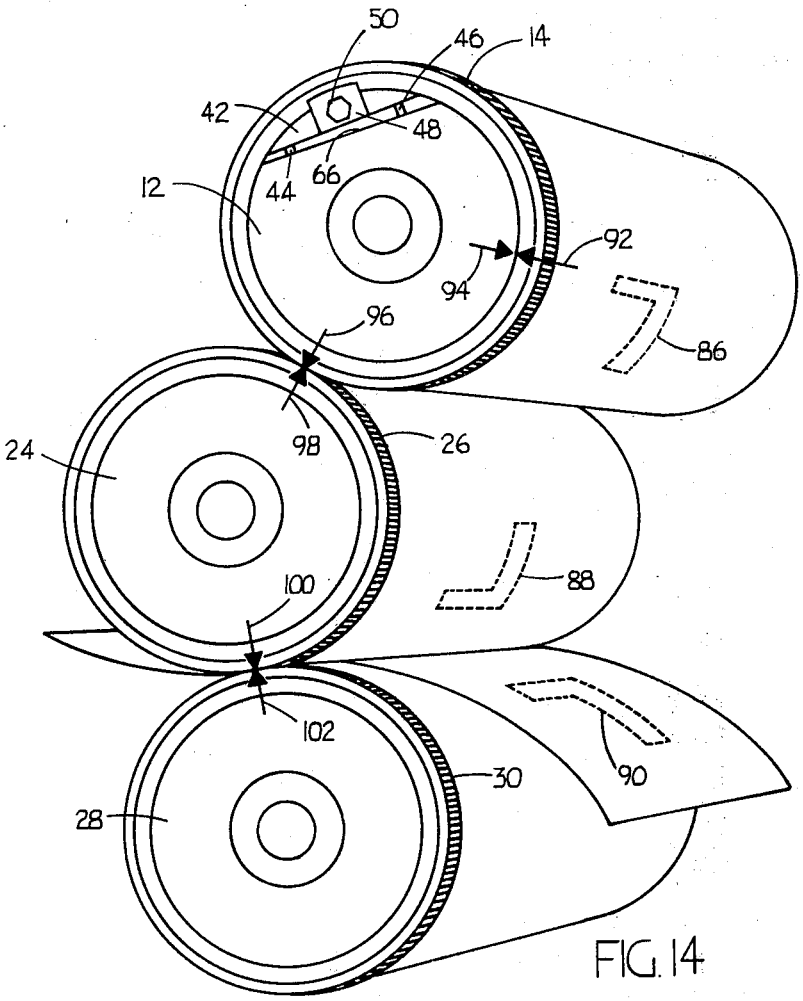
FIGS. 14–17 are diagrammatic representations illustrating the operation of the present invention.
Figure 17:
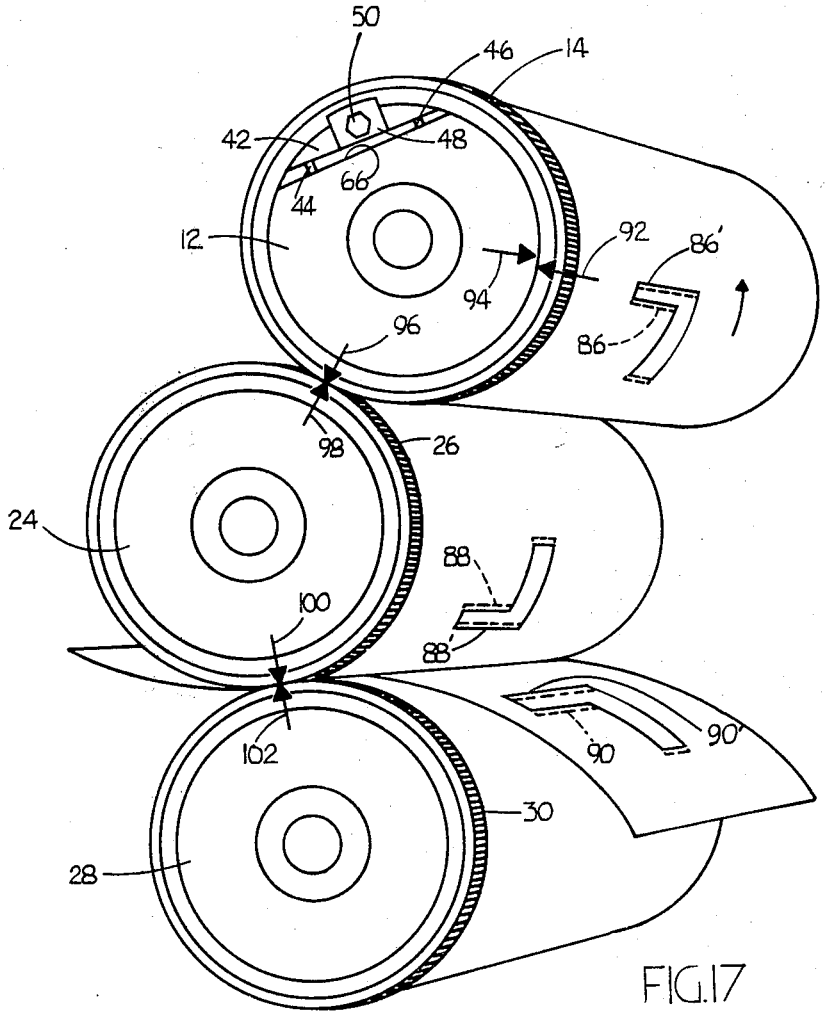

As seen in FIGS. 1 and 13, 14 and 17, the printing press 10 includes, in addition to the master cylinder 12 and master cylinder gear 14, a water roller 20, ink roller 22, blanket cylinder 24, blanket cylinder gear 26, impression cylinder 28 and impression cylinder gear 30. FIG. 1 is from the operator's side of the printing press 10, while FIGS. 13, 14 and 17, are taken from the non-operator's side of the printing press. The rotation of the elements 12, 20, 22, 24 and 28 is as shown by the arrows in FIG. 13. The blanket cylinder gear 26 and impression cylinder gear 30 are affixed to and drive their respective cylinders 24 and 28. As seen in FIGS. 14 and 17, the gears 14, 26, 30 on the master, blanket, and impression cylinders 12, 24 and 28 respectively, are normally meshed and thus when one gear is turned, they all turn.

The operation of the printing press 10 is quite conventional and will not be described in detail since such is quite well known to those skilled in the art. Suffice it to say that as seen in FIG. 13 the master cylinder 12 carries a replaceable master 32 which, during its rotation, has first water and then ink applied to it by the water and ink rollers 20, 22, respectively.

The master 32 then inks the image 34 on the blanket cylinder 24 which, in turn, inks the image 36 on the paper 38 as it is drawn and pressed between the blanket cylinder 24 and impression cylinder 28. The paper is then ejected from the cylinders 24, 28 in the direction of the arrow as shown.

Coarse vertical registration can be achieved in the conventional fashion by rotating the printing press's handwheel (not illustrated) until the clamp screw 16 is in line with the control handle 18. The handle 18 is then pressed inwardly and the master cylinder 12 is rocked with the handwheel until the socket on the handle 18 engages the clamp screw 16. The clamp screw is next loosened by rotating the handle 18. The clamp screw, along with the master cylinder 12, is then held in place with the handle 18 while the image is raised or lowered the desired amount by suitable rotations of the handwheel which engages and turns the gears 14, 26, and 30, and cylinders 24 and 28 with respect to the stationary master cylinder 12.

After the desired coarse vertical registration has been achieved, the clamp screw 16 is retightened with the handle 18, thereby resecuring the master cylinder gear to the master cylinder so they will rotate as one.

However it frequently, and even typically, happens that the coarse vertical registration achieved by the above procedure is unsatisfactory since an exact vertical registration is not obtained. It is to solve this problem that the present invention was devised.

Figure 2:
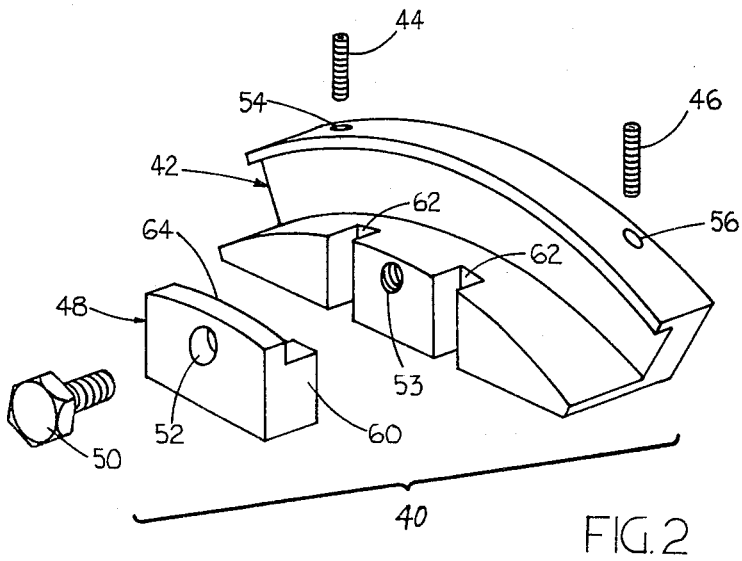
FIG. 2 is an exploded perspective view of the present invention.

Referring now to FIG. 2, the precision vertical registration adjustment device of the present invention, seen generally designated at 40, consists of five main parts; namely a shoe generally designated at 42, vertical adjustment screws 44, 46, a locking clamp generally designated at 48 and locking screw 50.

The locking screw 50 passes through a bore 52 in the locking clamp 48 and is screwed into a tapped bore 53 to releaseably secure the clamp 48 to the shoe 42. Tapped bores 54, 56, threadedly receive the vertical adjustment screws 44, 46, respectively.

Figure 3:
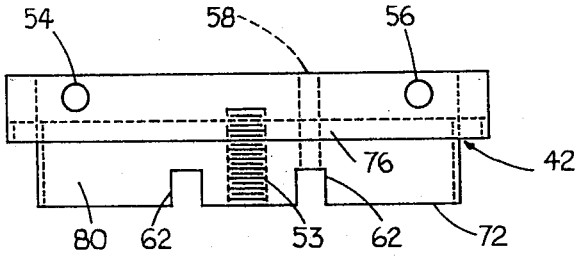
FIGS. 3 and 4 are a top plan view and a rear elevational view, respectively, of a portion of the present invention.
Figure 4:
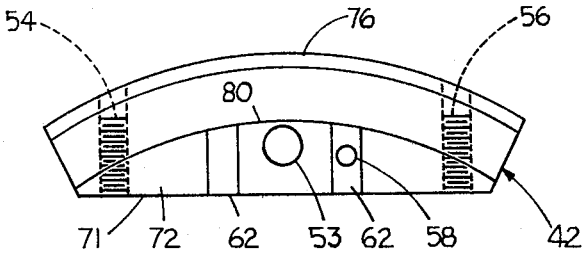

As seen in FIGS. 3–4, the shoe 42 includes an extension bore 58 through which any suitable implement can be inserted to extend the locking clamp 48 away from the shoe 42 on its locking screw 50, as will be further described below.

Figure 5:
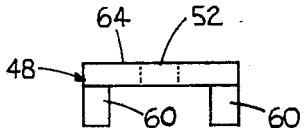
FIGS. 5–7 are top elevational, front elevational, and side elevational views, respectively, of another portion of the present invention.
Figure 6:
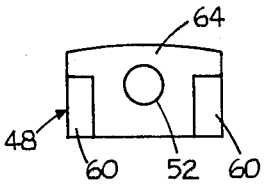
Figure 7:
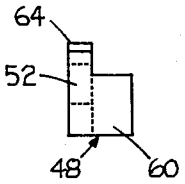
Figure 8:
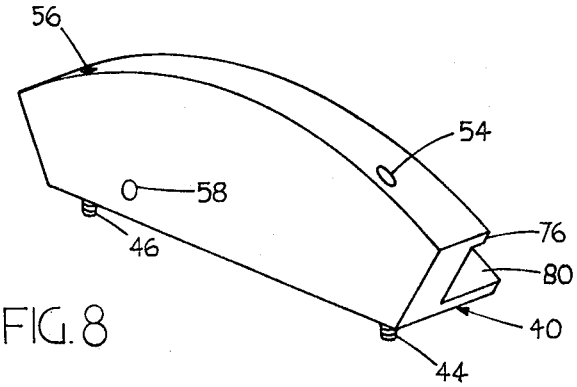
FIGS. 8 and 9 are front and rear perspective views, respectively, of the present invention when assembled.
Figure 9:
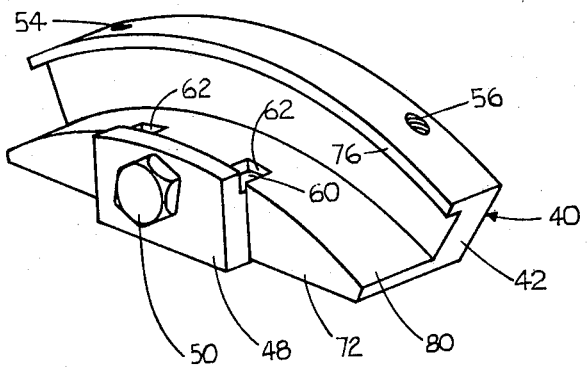

As best seen in FIGS. 5 and 9, the locking clamp 48 has a pair of arms 60 which are received in a pair of corresponding slots 62 in the shoe 42 when the device 40 is assembled. The arms 60 and slots 62 serve to keep the curved top portion 64 of the locking clamp 48 oriented upward, and also prevent the locking clamp 48 from twisting significantly as the clamp 48 is installed on the master cylinder gear 14 and as its locking screw 50 is tightened down (FIG. 10).

Referring now to FIGS. 1 and 10–12, it is seen that the master cylinder 12 has on one side a flat surface 66 which defines an opening 68 in conjunction with the inner surface 70 of the master cylinder gear 14. To install the assembled device 40, the locking screw 50 is backed almost all of the way out of its base, and the vertical extension screws 44, 46 are not extended past the bottom surface 71 of the shoe. The base 72 of the shoe is then inserted into the opening 68, as shown, until the top 64 of the locking clamp 48 clears the face 74 of the master cylinder gear 14. (A suitable probe may be inserted through the extension opening 58, as needed, to extend the locking clamp 48 past the face 74 of the gear 14).

Figure 10:
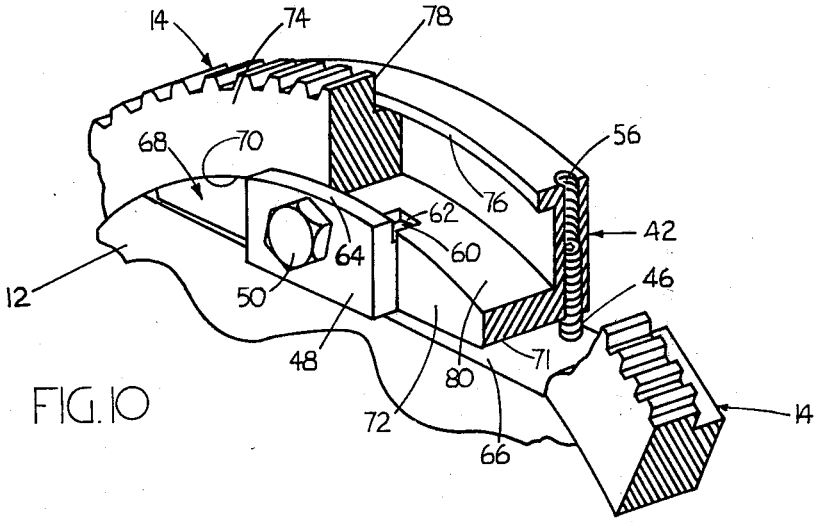
FIG. 10 is an elevational view of the present invention shown installed, with some parts being broken away for clarity.

At this time the device 40 is elevated until the top portion 64 of the locking clamp 48 extends past the inner surface 70 of the gear 14 and then the device 40 is pushed towards the gear 14 until its lip 76 fully engages the peripheral notch 78 on the gear 14, as seen in FIG. 10. The device 40 is then centered in the opening 68 and the locking screw 50 is tightened until the locking clamp 48 firmly engages the gear 14, thereby securing the device 40 to the gear 14. The spring loaded clamp screw control handle 18 which is part of the printing press 10 is used to tighten the locking screw 50 and is then released. Finally, the vertical adjustment screws are screwed out equally until they touch the flat surface 66.

Before proceeding with a description of the use of the device 40, there will now be given, by way of non limiting example, the measurements for a device 40 which worked extremely well with said Model 1250 printing press 10.

The inner surface of the lip 76 and the surface it engages on the notch 78 of the gear 14, have about the same curvature, namely they lie on a circle having a radius of about 2.877 inches. Similarly the curve of the top surface 80 of the base of the shoe and the inner surface 70 of the gear 14 have about the same curvature, namely, they lie on a circle having a radius of about 2.500 inches. The top surface 64 of the locking clamp 48 is arcuate and has a curvature which lies on the circumference of a circle with a radius of about 2.600 inches. The lip 76 overlies the notch 78 by about 0.117 inches. The top surface 80 of the base of the shoe has a width which is less than the maximum thickness of the gear 14.

The center of the bore 53 which receives the locking screw 50 lies on the circumference of a circle with a radius of about 2.350 inches. This is important since it means that the locking screw 50 will be positioned, when the device 40 is installed, at a location such that it can be engaged by the control handle 18 for tightening or loosening—thereby eliminating much inconvenience and the need for any special tools.

The slots 62 in the shoe 42 are about 0.245 inches deep and their corresponding arms 60 on the locking clamp 48 are about 0.256 inches long. The width of the top 64 of the clamp 48 is about 0.140 inches, while its maximum height is about 0.592 inches. The threaded portion of the locking screw 50 is about 0.500 inches long. The maximum thickness of the base 72 of the shoe is preferably at least about 0.125 inches less than the maximum height of the opening 68, and the maximum overall horizontal length of the base 72 of the shoe is about 2.780 inches.

Figure 15:
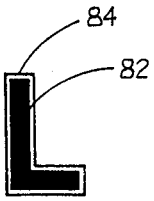

Turning now to the use of the device 40 of the present invention, it is first installed on the printing press 10 as has been described above. Let us assume, by way of example, that the printer wishes to print the character shown in FIG. 15 with the solid area 82 being printed in a first color and the border area 84 being printed in a second color, thereby requiring two runs of the paper through the printing press 10.

Figure 16:
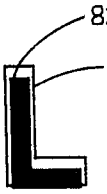

Let us further assume that the best vertical registration of the two colors which could be easily obtained on the first try by using the printing press 10 without the device 40 of the present invention is as is shown in FIG. 16. Obviously, the vertical registration of the character is not right and must be corrected. Let us assume that the border area 84 would have to be lowered relative to the solid area 82 in order to achieve proper registration.

In order to do this, after a run has been made on the press 10 such that only the solid area 82 has been printed on a plurality of sheets of paper, the clamp screw 16 on the master cylinder gear 14 is loosened in the manner previously described to permit the master cylinder 12 and master cylinder gear 14 to move relative to each other, and the handle 18 then is released so it no longer engages the clamp screw 16.

Referring now to FIGS. 14 and 17, in order to lower the border area 84 relative to the solid area 82, the master cylinder must be rotated such that the image 86 on the master cylinder is raised as viewed in the figures. This is done by simultaneously turning the vertical adjustment screws 44, 46 in opposite directions such that the master cylinder is forced away from the shoe 42 in the vicinity of screw 44, and towards the shoe 42 in the vicinity of screw 46. This, of course causes the master cylinder 12 to rotate relative to the stationary master cylinder gear 14 since the gears 14, 26, and 30 are held stationary by friction when the press 10 is not running, and the device 40 is held firmly clamped to the master cylinder gear 14 by the locking clamp 48. The initial positions of the characters 86, 88, 90 are shown in phantom in FIG. 17 while their positions after rotation of the master cylinder 12 are shown in solid as 86', 88' and 90'.

As seen by comparing the arrows 92 and 94 in FIGS. 11, 12, 14, and 17, the master cylinder 12 has rotated counterclockwise with respect to the stationary master cylinder gear 14. FIGS. 11 and 14 show before rotation has occurred, while FIGS. 12 and 17 show after rotation has occurred. A comparison of the arrows 96–102 in FIGS. 14 and 17, will reveal that during rotation of the master cylinder 12 with respect to its gear 14, the gears 14, 26 and 30 and the cylinders 24 and 28 do not rotate with respect to each other.

As can be seen by comparing FIGS. 14 and 17, when the vertical adjustment screws are simultaneously turned as described above, the master cylinder is rotated, causing the ends of the screws 44, 46 to be dragged across the flat surface 66 of the master cylinder 12. This action is assisted if the ends of the screws 44, 46 are rounded, and a suitable lubricant applied to the flat surface 66.

Raising the border area 84 relative to the solid area 82 would be accomplished by suitably turning the adjustment screws to rotate the master cylinder 12 such that the image 86 on the master cylinder would be lowered as viewed in FIGS. 14 and 17.

After the border area 84 has been vertically adjusted the desired amount, the handle 18 is used to tighten the clamp screw 16, thereby resecuring the master cylinder gear 14 to the master cylinder 12.

The desired amount of vertical movement of the image 86 either up or down can be easily found. For example, it has been determined that for the device 40 which has been described in detail, the vertical adjustment screws 44, 46 have 32 threads per inch meaning that one full turn moves them 0.03125 inches. By simply printing an image on the same paper before and after the adjustment screws have been turned one full turn it was determined that one full turn of the screws 44, 46 moved the printed image a distance 0.078 inches up or down, as the case may be. Knowing how much the image is moved for one turn of the screws 44, 46, permits the easy calculation of how many turns or part of a turn of the screws 44, 46 is needed to produce any needed vertical adjustment of the printed image, down to adjustments of only 5 or 6 thousands of an inch. For the device 40 described, the maximum vertical movement of the printed image was 0.625 inches.

If it is desired to move the printed image more than 0.625 inches, the coarse vertical adjustment is made by using the existing press' conventional adjustment procedure previously described, after first loosening the device 40's locking screw 50 and clamp 48 to permit the device 40 and gear 14 to move relative to each other. After the coarse vertical adjustment is made the screw 50 and clamp 48 are tightened to secure the device 40 to the gear 14 once again, after which the device 40 can be used to make the final, precision vertical adjustment in the manner previously described.

An important advantage to the present invention is that it can be secured to the master cylinder gear 14 at any desired location on the gear's circumference. This means, of course, that the device 40 can be used for precision vertical registrations even if the images 86 on consecutive masters are out of vertical registration by many inches.

The master cylinder 12, best seen in FIG. 1, is, by way of non-limiting example, a Multilith master cylinder model no. 296-370. Naturally, for best results, the master cylinder 12 and master cylinder gear 14 should be thoroughly cleaned and lightly oiled before installation of the vertical registration adjustment device 40.

Turning now to FIGS. 18–21, a second form 40' of the invention is illustrated. Since it, and the printing press with which it is used, are structurally very similar to the first form of the invention and the printing press shown in FIGS. 1–17, corresponding parts have been given the same reference numerals in FIGS. 18–21, with a prime apended thereto. The second form 40' of the invention is also adapted to be used with printing presses of the type having a master cylinder and a master cylinder gear which are selectively rotatable with respect to each other.

The form shown in FIGS. 18–21 is sized so as to be especially adapted to be used, by way of non-limiting example, with a Multilith 1250 printing press having a master cylinder model no. 120-3710.

As best seen in FIGS. 20 and 21, a generally rectangular opening 68' is defined between the curved inner surface 70' of the master cylinder gear 14', and the sides 110 and bottom 112 of the plate clamp assembly recess 114 in the master cylinder 12'. Note that the vertical registration adjustment device 40' is sized and shaped to be adapted to fit within this opening 68' to enable it to be clamped to the master cylinder gear 14', without interfering with the other parts of the printing press with which it is adapted to be used. The device 40' is about 1½ inches wide at its bottom, has a maximum height of about ⅞ths of an inch, and the maximum thickness of its shoe 42' is also about ⅞ths of an inch.

In view of the detailed disclosures set forth regarding the exact size and shape of the device 40 shown in FIGS. 1–17, it is believed that it is now easily within the ability of one of ordinary skill in the art to properly size and shape the device 40' shown in FIGS. 18–22, so that it will function as intended.

Features to be noted regarding the device 40' are an arcuate chamfer 116 on its lip 76' which helps prevent interference with the idler gear assembly (not illustrated) of the printing press with which the device 40' is adapted to be used. Such an arcuate chamfer 116 could be provided on the device 40 seen in FIGS. 1–17 should it appear necessary.

The corner chamfers 118 and 120 on the device 40' are provided in order to help prevent damage to the corners of the printing plate used with the master cylinder 12 when the plate is drawn tight to the master cylinder 12 by the plate clamp assembly prior to commencing a press run.

The chamfers 116, 118, 120 illustrate, by way of example, to one of ordinary skill in the art that the device 40' must be suitably sized and shaped so as to avoid interference with the other parts of the printing press with which the device 40' is adapted to be used.

An important structural difference between the device 40' of FIGS. 18–21 and the device 40 of FIGS. 1–17, is that the vertical registration adjustment screws 44', 46' and the bores 54' 56' of the device 40' are diagonally oriented, while those of the device 40 are vertically oriented. Thus, the vertical registration adjustment screws 44', 46' act against the sides 110 of the opening 68', while in the device 40 the screws 44,46 act against the bottom 66 of the opening 68.

Accordingly, it is seen that where the opening 68 or 68' is relatively wide, the vertical registration adjustment screw arrangement of the device 40 is preferred. On the other hand, where the opening 68 or 68' is relatively deep and narrow, the screw arrangement of the device 40' is preferred. This is because the object is to maximize the range of vertical registration adjustment provided by the adjustment screws of the device 40, 40' regardless of the precise shape of the opening 68 or 68'.

Another feature of the device 40' which is to be noted is the unusual compactness provided by its ingenious use of diagonal bores 54', 56', best seem in FIGS. 18–19. It should be noted that these bores actually intersect and lie in at least substantially the same plane. The adjustment screws 44', 46' are sized shorter than the distance between the outside of the device 40' and the intersection 122 of the bores 54' 56', in order to prevent interference between the screws 44', 46', even when they are completely within the device 40'.

Naturally, each bore 54',56' is straight, thereby permitting the insertion of a suitable tool therein to turn a respective screw 44', 46' as desired.

Turning now to other matters, it may not be preferable, or possible, in all cases to size and shape the device 40' to avoid interference with the other parts of the printing press with which the device 40' is adapted to be used. In such cases it is often possible to avoid such undesired interference by suitably modifying various parts of said printing press to avoid interference with the device 40'.

For example, a Multilith 1250 printing press having said master cylinder model number 120-3710 is normally equipped with a plate clamp assembly which may give rise to said interference with the device 40'. Typical plate clamp assemblies used with the 120-3710 master cylinder are the lateral (angular) adjustment plate clamp assembly, the multimaster plate clamp assembly, or the universal lateral adjustment plate clamp assembly (not illustrated).

Regardless of which plate clamp assembly is being used, interference with the device 40' can be eliminated by removing about three-eights of an inch from the end of the pinbar portion of the plate clamp assembly which is closest to the master cylinder gear 14' when the plate clamp assembly is installed on the master cylinder 12'.

However, as a result of this shortening of the pinbar portion of the plate clamp assembly, each offset printing plate (not illustrated) which is used with the master cylinder 12' will have an extra pinbar hole at its top and bottom corners on its side located towards the master cylinder gear 14'. Thus, it is preferred that an angular cut be made across each said corner of the plate to eliminate the extra holes and facilitate movement of the device 40' under the corners of the plate.

Note that said angular cuts should not exceed the gripper margin at the top of the plate and should not be located so as to affect the image area at the bottom of the plate.

Installation and use of the device 40' of FIGS. 18–21 is the same as has been described previously with respect to the device 40 of FIGS. 1–17, except it is necessary to remove the plate clamp assembly from the master cylinder 12' to initially install the device 40' on the master cylinder gear 14', after which the plate clamp assembly can be reinstalled on the master cylinder 12' in the usual fashion.

Turning now to other matters, it may happen that even though the particular printing press with which the vertical registration adjustment device of the present invention is adapted to be used has a master cylinder and a master cylinder gear which are selectively movable with respect to each other, the construction of the master cylinder may be such that the opening 68 or 68' at the gear end of the master cylinder may be too small, or may even be nonexistent. By way of non-limiting example, the Multilith master cylinder model No. 120W-450 and interim universal master cylinder (not illustrated) have openings at their gear ends which are likely not large enough to be conveniently used; while the Multilith old style universal master cylinders (two types) and old style multimaster master cylinders do not have any opening at all at their gear ends.

If the said openings are too small to be conveniently used or are nonexistent, then it is preferred in each case to modify the master cylinder so as to provide a suitable opening in the gear end of the master cylinder. Said opening will be sized and shaped so that it will accommodate a vertical registration adjustment device of the present invention, to permit said device to be clamped to the master cylinder gear and operate in the manner previously described.

To provide such an opening in any one of the master cylinders mentioned above by way of example where the master cylinder has no opening or too small an opening, the master cylinder is first removed from the printing press. Then a suitable opening is made in the gear end of the master cylinder adjacent the plate clamp assembly recess 114 in the master cylinder by any conventional technique, such as by the use of hand tools including hacksaw, drill, jigsaw and file, or the work may be done by a machine shop, if desired.

By way of non-limiting example, a suitable opening can be generally trapezoidal in shape. The sides of the trapezoid lie on radii passing through the center of the gear end of the master cylinder, and are about 1.250 inches long. The imaginary outer wall of the trapezoid is arcuate, lies on the circumference of the outer surface of the master cylinder, and has a length of about 2.250 inches. The bottom wall of the trapezoid is straight and extends between the bottoms of the side walls of the trapezoid.

It is to be emphasized that the above is not the only shape of opening which could be provided in the gear end of the master cylinder, since in view of the disclosures herein, many other suitable openings of various sizes and shapes could be provided by one of ordinary skill in the art. Also, the opening could be at least partly provided by cutting away part of the master cylinder gear, but this is not preferred since it may weaken the master cylinder gear.

It should be noted that if it were desired, the opening described above which was made in the gear end of the master cylinder, could have been sized and shaped so as to be usable with either the device 40 or 40'.

However, once a particular suitable opening in the ring gear end of the master cylinder is provided, it would then be readily apparent to one of ordinary skill in the art, in view of the disclosures herein, to provide a suitable vertical registration adjustment device according to the present invention which would be adapted to fit within said opening, be attached to the ring gear, and operate in the manner previously described.

Turning now to the particular trapezoidal shaped opening described above, a suitable vertical registration adjustment device would be very similar in overall configuration, construction, and operation to the device 40' shown in FIGS. 18–21, except that its cross sectional configuration would be adjusted to fit within the trapezoidal opening described above. Its installation and use would be as described previously regarding the device 40'.

Naturally, undesirable interference between the device and the other parts of the printing press is avoided, for example, by suitably sizing and shaping the device, as by providing chamfers on the device and/or by modifying, as necessary, the particular plate clamp assembly used on the printing press. It is felt that all such modifications needed to produce a suitable vertical registration adjustment device according to the present invention are well within the skill of one of ordinary skill in the art in view of the disclosures herein.

A special note regarding all of the Multilith printing presses which use any of the master cylinders described above is that if the printing press is equipped with a T-51 second color head, the use of a short operating tool to adjust the vertical adjustment screws of the device of the present invention is recommended due to the small working space available on printing presses so equipped.

It should be again recalled that the vertical registration adjustment device of the present invention is usable on any brand or kind of printing press having a master cylinder and a master cylinder gear which are selectively rotatable with respect to each other, as long as a suitable opening in the master cylinder for mounting the device of the present invention to the master cylinder gear exists or can be provided, as long as suitable non-interference between the device and the printing press can be provided, and as long as access to the device's locking screw and vertical registration adjustment screws can be provided.

Thus, the Multilith 1250 printing press described above is not the only printing press with which the vertical registration adjustment device according to the present invention can be used. By way of further non-limiting example, the device of the present invention can also be used with Hamada models 500, 600 and 700 printing presses manufactured by Hamada Printing Press Manufacturing Company, Ltd., located in Osaka, Japan.

The Hamada printing presses are very similar to the Multilith 1250 printing press already described. They too have a master cylinder and a master cylinder gear which are selectively rotatable with respect to each other when the control handle on the Hamada press (located on the opposite side of the press from the master cylinder gear) loosens the clamping screw which holds the master cylinder gear fixed with respect to the master cylinder.

Some differences are that the Hamada master cylinder gear has a greater circumference and a different cross sectional configuration as compared to the Multilith master cylinder gear.

Since the Hamada presses have no suitable opening between their master cylinders and their master cylinder gears in which the device of the present invention can be mounted, such an opening must be provided. It is provided in the same fashion as was described earlier regarding the Multilith 1250 press in which a suitable opening in the press's master cylinder had to be provided.

Very briefly, the plate clamp assembly is removed from the Hamada master cylinder and then the master cylinder is removed from the Hamada printing press. A suitable opening is provided in the ring gear end of the master cylinder adjacent the plate clamp assembly recess in the master cylinder, as by the use of hand tools, or by taking the master cylinder to a machine shop to have the work done. Then the modified master cylinder is reinstalled in the printing press after which a suitable device of the present invention is installed on the master cylinder gear in the opening which was provided in the master cylinder.

Suitably sizing and shaping the opening in the master cylinder, and suitably sizing and shaping the device of the present invention will be readily apparent to one of ordinary skill in the art in view of the disclosures herein.

After the device of the present invention is installed, the plate clamp assembly is reinstalled on the master cylinder. The device of the present invention is then ready for use.

One important modification of the device of the present invention made necessary by the construction of the Hamada presses is that the present invention's locking screw must be located on the inside of the master cylinder when the device is installed on the Hamada press due to the construction of the Hamada presses, whereas on the Multilith 1250 press described previously, the device's locking screw was located on the outside of the master cylinder when the device was installed.

This change in the construction of the device of the present invention when used on the Hamada press simply means that the present invention's locking screw must be loosened and tightened with a suitable hand wrench, for example, since it cannot be actuated by the Hamada presses's control handle which is normally used to release the press's clamp screw when it is desired to rotate the press's master cylinder and master cylinder gear relative to each other.

It should be noted that on the Multilith 1250 press discussed earlier, it is possible to locate the locking screw of the device of the present invention on the inside of the master cylinder, even though it is preferred that it be located on the outside of the master cylinder so that it could be actuated by the Multilith press's control handle 18.

By way of non-limiting example, the device 40' of the form of the invention shown in FIGS. 18–21, has been modified as shown in FIG. 22 so that its locking screw 50' is located on the inside of the master cylinder when the device 40' is installed. Since the device 40'' shown in FIG. 22 is identical in all respects, except as noted below, to the device 40' shown in FIGS. 18–21, similar parts in the device 40'' shown in FIG. 22 will be given the same reference numerals with a double prime appended thereto.

There are several differences between the devices 40'' and 40''. The device 40'' needs no extension bore 58' since its locking clamp 48'' can be extended as needed by use of its locking screw 50''. In addition, its bore 53'' extends completely through the shoe 42'' so the locking screw 50'' can engage its locking clamp 48''. The installation and use of the device 40'' is the same as for the device 40' except for the extension of the locking clamp 48'' mentioned above, and except that its locking screw 50'' is loosened and tightened as desired with any suitable wrench rather than by the use of the press's control handle 18.

In view of the disclosures above, it will now be apparent to one of ordinary skill in the art how to provide a suitable device of the present invention wherein its locking screw is located on the inside of the master cylinder when the device is installed, regardless of whether the press is a Multilith, a Hamada, or any other press of the type described herein with which the device of the present invention is adapted to be used.

Whenever a device of the present invention is used, it is preferred that a vertical registration adjustment guide (not illustrated) be provided to the user. The registration guide consists of a simple card, for example, with a series of lines of different thickness printed on it along one edge, with the lines arranged perpendicular to the edge. Alongside each line is a number indicating how much each vertical registration adjustment screw of the device of the present invention must be turned in order to change the vertical registration of the image printed by the press by the width of that particular line. Creation of the guide for any given device and press is done by simply running successive sheets of paper through the printing press, adjusting the vertical registration adjustment screws of the device of the present invention a given amount each time a new sheet of paper is run through the press, and noting how much change in the vertical registration of the printed image that occurs between successive sheets of paper.

From the foregoing, various further applications, modifications and adaptations of the apparatus disclosed by the foregoing preferred embodiments of the present invention will be apparent to those skilled in the art to which the present invention is addressed, within the scope of the following claims.

What is claimed is:

1. A precision vertical registration adjustment device for a printing press of the type having a master cylinder driven by a circular master cylinder drive gear; wherein said master cylinder drive gear is releasably secured to the periphery of one end of said master cylinder with at least one master cylinder drive gear clamp bolt; wherein an opening is provided between said master cylinder and said master cylinder drive gear; wherein said printing press has an installed control handle means for selectively loosening and tightening said at least one master cylinder drive gear clamp bolt to permit selective relative rotation between said master cylinder and said master cylinder drive gear; and wherein said device comprises:

shoe means, wherein said shoe means defines a master cylinder drive gear slot which is adapted to accept a corresponding part of said master cylinder drive gear to permit said corresponding part of said master cylinder drive gear to be selectively firmly engaged by said master cylinder drive gear slot when said device is installed on said master cylinder drive gear;

locking means comprising a locking clamp means and locking clamp drive means, wherein said locking clamp drive means extends between and is adapted to interconnect said shoe means and said locking clamp means when said device is installed on said master cylinder drive gear; and wherein said locking clamp means and said shoe means are adapted to be selectively driven by said locking clamp drive means to selectively tightly sandwich and release said master cylinder drive gear between said locking clamp means and said shoe means, to selectively releaseably secure said device to said master cylinder drive gear when said device is installed on said master cylinder drive gear; and vertical registration adjustment means carried by said shoe means, wherein said vertical registration adjustment means comprise a pair of adjustment screws carried by said shoe means; wherein said adjustment screws are spaced apart from each other and are adapted to bear against the same side of said opening between said master cylinder and said master cylinder drive gear to selectively rotate said master cylinder and said master cylinder drive gear with respect to each other when said adjustment screws are selectively actuated to extend one of said adjustment screws while the other of said adjustment screws is retracted, when said device is installed on said master cylinder drive gear;

wherein when said device is installed on said master cylinder gear, a portion of at least one of said shoe means and said locking clamp means is adapted to pass through said opening between said master cylinder and said master cylinder drive gear; and wherein when said device is installed on said master cylinder gear, said locking clamp drive means is sized and located to be adapted to permit said installed control handle means on said printing press to be used to drive said locking clamp drive means.

2. A precision vertical registration adjustment device for a printing press of the type having a master cylinder driven by a circular master cylinder drive gear; wherein said master cylinder drive gear is releaseably secured to the periphery of one end of said master cylinder; wherein an opening is provided between said master cylinder and said master cylinder drive gear; and wherein said device comprises:

shoe means, wherein said shoe means defines a master cylinder drive gear slot which is adapted to accept a corresponding part of said master cylinder drive gear to permit said corresponding part of said master cylinder drive gear to be selectively firmly engaged by said master cylinder drive gear slot when said device is installed on said master cylinder drive gear;

locking means comprising a locking clamp means and locking clamp drive means, wherein said locking clamp drive means extends between and is adapted to interconnect said shoe means and said locking clamp means when said device is installed on said master cylinder drive gear; and wherein said locking clamp means and said shoe means are adapted to be selectively driven by said locking clamp drive means to selectively tightly sandwich and release said master cylinder drive gear between said locking clamp means and said shoe means, to selectively releaseably secure said device to said master cylinder drive gear, when said device is installed on said master cylinder drive gear; and vertical registration adjustment means carried by said shoe means, wherein said vertical registration adjustment means comprise a pair of adjustment screws carried by said shoe means; wherein said adjustment screw means are adapted to bear against opposing sides of said opening between said master cylinder and said master cylinder drive gear to selectively rotate said master cylinder and said master cylinder drive gear with respect to each other when said adjustment screws are selectively actuated to extend one of said adjustment screws while the other of said adjustment screws is retracted, when said device is installed on said master cylinder gear;

wherein when said device is installed on said master cylinder drive gear, a portion of at least one of said shoe means and said locking clamp means is adapted to pass through said opening between said master cylinder and said master cylinder drive gear.

3. A precision vertical registration adjustment device for a printing press of the type having a master cylinder driven by a circular master cylinder drive gear, wherein said master cylinder drive gear is releaseably secured to one end of said master cylinder to selectively permit relative rotation therebetween; wherein said device comprises:

shoe means;

locking means which, when said device is installed on said master cylinder drive gear, are for releaseably securing said shoe means to said master cylinder drive gear; and vertical registration adjustment means carried by said shoe means, which, when said device is installed on said master cylinder drive gear, are adapted to extend between said shoe means and said master cylinder;

wherein said vertical adjustment means are for causing said master cylinder and said master cylinder drive gear to selectively rotate with respect to each other;

wherein said locking means comprises locking clamp means, and locking clamp drive means extending between said shoe means and said locking clamp means, when said device is installed on said master cylinder drive gear;

wherein said locking clamp means and said shoe means are adapted to be selectively driven by said locking clamp drive means to, when said device is installed on said master cylinder drive gear, selectively tightly sandwich and release said master cylinder drive gear between said locking clamp means and said shoe means, to selectively releaseably secure said device to said master cylinder drive gear;

wherein said locking clamp means includes at least one locking clamp arm means;

wherein said shoe means includes at least one corresponding arm slot means; and wherein, when said device is installed on said master cylinder drive gear, said arm means is adapted to engage said arm slot means to at least substantially prevent undesired rotation of said locking clamp means and said shoe means with respect to each other during at least a portion of the travel of said locking clamp means when said locking clamp means is being driven by said locking clamp drive means.

4. A precision vertical registration adjustment device for a printing press of the type having a master cylinder driven by a circular master cylinder drive gear, wherein said master cylinder drive gear is releaseably secured to one end of said master cylinder to selectively permit relative rotation therebetween; wherein said device comprises:

shoe means;

locking means which, when said device is installed on said master cylinder drive gear, are for releasably securing said shoe means to said master cylinder drive gear; and vertical registration adjustment means carried by said shoe means, which, when said device is installed on said master cylinder drive gear, are adapted to extend between said shoe means and said master cylinder;

wherein said vertical adjustment means are for causing said master cylinder and said master cylinder drive gear to selectively rotate with respect to each other;

wherein said locking means comprises locking clamp means, and locking clamp drive means extending between said shoe means and said locking clamp means, when said device is installed on said master cylinder drive gear;

wherein said locking clamp means and said shoe means are adapted to be selectively driven by said locking clamp drive means to, when said device is installed on said master cylinder drive gear, selectively tightly sandwich and release said master cylinder drive gear between said locking clamp means and said shoe means, to selectively releasably secure said device to said master cylinder drive gear;

wherein said printing press is of the type further having at least one clamp bolt for releasably securing said master cylinder drive gear to said master cylinder, and having an installed control handle means for selectively tightening and loosening said at least one clamp bolt; and wherein said locking clamp drive means is sized and located, when said device is installed on said master cylinder drive gear, to be adapted to permit said control handle means to be used to drive said locking clamp drive means.

5. A precision vertical registration adjustment device for a printing press of the type having a master cylinder driven by a circular master cylinder drive gear, wherein said master cylinder drive gear is releasably secured to one end of said master cylinder to selectively permit relative rotation therebetween; wherein said device comprises:

shoe means;

locking means which, when said device is installed on said master cylinder drive gear, are for releasably securing said shoe means to said master cylinder drive gear; and vertical registration adjustment means carried by said shoe means, which, when said device is installed on said master cylinder drive gear, are adpated to extend between said shoe means and said master cylinder;

wherein said vertical adjustment means are for causing said master cylinder and said master cylinder drive gear to selectively rotate with respect to each other;

wherein said locking means comprises locking clamp means, and locking clamp drive means extending between said shoe means and said locking clamp means, when said device is installed on said master cylinder drive gear;

wherein said locking clamp means and said shoe means are adapted to be selectively driven by said locking clamp drive means to, when said device is installed on said master cylinder drive gear, selectively tightly sandwich and release said master cylinder drive gear between said locking clamp means and said shoe means, to selectively releaseably secure said device to said master cylinder drive gear; and wherein said shoe means includes a master cylinder drive gear slot which is shaped to be adapted to accept a corresponding part of said master cylinder drive gear, to permit said corresponding part of said master cylinder drive gear to be firmly engaged by said master cylinder drive gear slot when said device is installed on said master cylinder drive gear.

* * * * *